US005207792A

United States Patent [19]

Anderson

[11] Patent Number: 5,207,792

[45] Date of Patent: May 4, 1993

[54] HOME BUILDING BOARD GAME

[76] Inventor: Janet Anderson, 304 Joy Dr., Hot Springs, Ark. 71913

[21] Appl. No.: 684,068

[22] Filed: Apr. 11, 1991

[51] Int. Cl.[5] ..... A63F 3/00

[52] U.S. Cl. ..... 273/256

[58] Field of Search ..... 273/256, 243, 246

[56] References Cited

U.S. PATENT DOCUMENTS

| | | | |
|---|---|---|---|
| 3,416,802 | 12/1968 | Montes | 273/246 |
| 4,279,422 | 7/1981 | Shaw | 273/243 |
| 4,890,843 | 1/1990 | Chauve | 273/256 |
| 4,902,020 | 2/1990 | Auxier | 273/256 |

FOREIGN PATENT DOCUMENTS

| | | | |
|---|---|---|---|
| WO8809690 | 12/1988 | PCT Int'l Appl. | 273/256 |
| 2193900 | 2/1988 | United Kingdom | 273/256 |

*Primary Examiner*—Benjamin H. Layno
*Attorney, Agent, or Firm*—Dowell & Dowell

[57] ABSTRACT

A combination construction board game and advertising medium which includes a board having a first series of spaces over which playing pieces are moved to acquire financing and to make selections with respect to housing plans and types of construction which are selected and are purchased using a first set of cards and a second series of spaces where players pay off construction loans and furnish the homes being constructed with amenities selected from a second set of cards which designate a variety of fixtures, furniture and/or home improvements or amenities and wherein at least some of the cards displaying amenities carry advertising of the actual manufacturer of the product or service.

17 Claims, 4 Drawing Sheets

FIG.6

38

YOUR PROPERTY VALUE IS DOWN

FIG.6A

39

OLDER NEIGHBORHOOD STARTS TO DETERIORATE ECT.

PAY $3,000

GO BACK 3 SPACES. DO NOT TAKE CARD, COLLECT MONEY OR SALARY.

FIG.7

30

YOUR PROPERTY VALUE IS UP

FIG.7A

31

ADVERTISEMENT

ACCESS ROAD COST IS LOW
COLLECT $14,000

YOU MUST BUY 1. YOU MAY BUY. ONE OR ALL. LIMIT OF 1 EACH
LOT _____ SIDING
BUILDER _____
OR BUILD YOUR SELF _
ARCHITECT _____

FIG.8

40

CONSTRUCTION PROBLEM

FIG.8A

41

LAWSUIT OVER POOR WORKMANSHIP PROVES FUTILE BECAUSE WORKMAN HAS NO CAPITAL.
SAFE IF YOU MOVE 3 OR 4
SAFE IF BUILDER OR ARCHITECT CARD HAS 2
OTHERWISE: PAY $17,000 AND GO BACK TO THE LAST YELLOW SPACE BUT DO NOT MAKE PURCHASE AGAIN

FIG.9

32

PHOTO

ADVERTISEMENT

ARCHITECT
COST $11,000
SCORING POINTS $15,000

FIG.9A

33

ARCHITECT

1. ARCHITECT CAUGHT ERROR IN FOUNDATION

2. OWNER CARRIES LIABILITY INSURANCE

FIG. 10

34

PHOTO

ADVERTISEMENT

BUILDER
COST $9000
SCORING POINTS $12,000

FIG. 10A

35

1. A GOOD BUILDER WILL NOT MAKE MONEY BY DEVIOUS METHODS AFTER GIVING A LOW BID.
2. BUILDER TAKES OUT INSURANCE.
3. HAS HIS OWN CREW
4. BUILDER HAS A REPUTATION FOR RELIABILITY.

FIG. 11

36

FRAMING/SIDING

ADVERTISEMENT

COST $30,000

SCORING POINTS $35,000

SIDING
BRICK
VINLY
ALUMINUM
WOOD
STUCCO

FIG. 12

37

ADVERTISEMENT

LOT COST $33,000
POINTS $40,000

DESCRIPTION OF PROPERTY
PARCEL NO. LOT
ACREAGE 2

FIG. 13

58

INTERIOR ROOM
POINTS 20,000
BEDROOM $20,000
JAN CARPET

FIG. 14

59

$100 X DICE ROLL
DISHWASHER
MANUFACTURE NAME
POINT VALUE 650

VALUE $600

42

CHANGES CAUSE DELAY

1ST PLAYER TO REACH THIS CARD MUST STOP UNTIL:
1. PLAY A "SAFE" CARD, OR
2. ROLL DOUBLES, OR
3. LOSE 1 TURN AND PAY THE PLAYER WHO PLACED THIS CARD. $20,000

FIG. 15A

43

6 CHANGES CAUSE DELAY CARDS

REVERSE SIDE OF 3 SAY "SAFE" THE REST ARE BLANKS

FIG. 15

46

$10,000 00

FIG. 16

HOME BUILDING BOARD GAME

BACKGROUND OF THE INVENTION

1. Field of the Invention

The invention is generally directed to board games of a type where chance devices are utilized to select the amount of spaces games pieces are moved with respect to squares set out on a game board and wherein cards are utilized to promote advancement of the playing pieces or retard the movement of the playing pieces during the progress of the game. More specifically, the invention is a combination construction board game and advertising medium which is designed to educate players with respect to home purchasing and financing and wherein real products are displayed which must be purchased during progress of the game in order to provide amenities to the home such that the total of the amenities and bonuses provided during the game provide the basis for determining the outcome of the game.

The present invention includes a board game in which a first series of spaces are provided on the surface of the board which designate both positive and negative situations in which the player receives financing or must pay fees so that over a series of spaces income is established to purchase and then to furnish and construct a home. The game includes a first number of cards designating homes of various price ranges which a player may obtain and which require that various financing be made with respect to the home during the course of play. Each home building card also includes the provision for payments which will be received at certain points during the course of play.

In the preferred embodiment, during a player's movement through the first series of spaces not only is financing obtained for purchasing a home and to provide for its construction and furnishing but also selections may be made with respect to builders, architects, lots and siding. Each of these cards includes a base price cost and also a provision for the amount of points that the card is worth in calculating the outcome of the game. In some instances, such as with builders or architects, the back of the cards will reflect bonus situations which may effect the outcome of the game by countermanding or augmenting instructions which are received at various spaces along the game board dependent upon the value of the purchase price paid, i.e. the better the builder's qualifications the less likelihood that there would be obstacles to the successful completion of the home construction for failure to obtain necessary permits or for poor quality construction.

The game board also includes a second series of spaces over which the game pieces are moved and wherein mortgages are paid and wherein specific amenities must be purchased from a group of amenities reflected on separate amenity cards. In this respect, the game incorporates advertising of specific amenities which may be purchased, such as to complete a bathroom, a kitchen, a bedroom or a dining room and the like. The amenity cards will reflect actual products available on the market so that the game is made more realistic. Such cards also indicate the purchase price of the amenity and a separate point score which may utilized when calculating the final score of the game.

Once a mortgage has been fully satisfied and the necessary amenities obtained provisions are made for ending the game with the winner being determined by the player having the most total points as indicated by the value of their property and all amenities accrued during the course of play.

In addition to the first and second series of spaces provisions are made in the game for allowing a player to move from one series of spaces to another so that if a player becomes bankrupt or does not have sufficient money to continue play they may move back into the first series of spaces in order to collect further capital to continue play. As previously discussed, the game also incorporates construction problem cards associated with the completion of the home and which may penalize a player in the event that proper procedures have not been followed or adequate guidance not provided for earlier in the game by a selection of adequate builders and architects and the like.

2. History of the Related Art

Heretofore there have been numerous board games designed for allowing players to move game pieces about a playing surface which designates properties which may be purchased during the course of play with the advancement of game pieces being controlled by some selection device such as a spinner, cards or dice. In the most well-known types of board games of this type money is initially advanced from a bank to each of the players with additional monies being paid either by landing on spaces on which players are subject to payments or penalties or wherein players receive additional funds as they move to certain points with respect to the game board. The object is to acquire property in many cases for which other players must pay rent if they land on spaces owned by another player. The object of the game is to acquire monopolies and to make investments to build properties having cash value which are greater than the other players of game and to deplete the cash reserves of the other players by acquiring their assets. Unfortunately, such games do not educate an individual with respect to the details with respect to home building and home selection as well as home mortgaging and house furnishing. Also, most of the information relative to the game board is related to control cards which do no deal directly with the problems associated with home building and financing.

In U.S. Pat. No. 1,448,819 a game board is disclosed for purchasing a house by random selection of tokens which are positioned face down and which carry various indicia of money value. Tokens are drawn by players randomly until a given player reaches the purchase price of the house at which time the game is over. Such a game, although directed towards purchasing a particular home, does not allow a player to select a home they would wish to purchase and then make decisions with regard to financing and for furnishing the home as well as for paying off mortgages during the course of play.

In U.S. Pat. No. 1,085,202 to Gingras a game is disclosed wherein players assemble a number of cards of different categories indicating lots, mortgage values, and house values and wherein the cards also designate game point values which are added to determine the winner of the game. Play is determined by a spinner located centrally of the game board and which directs certain actions to be taken with respect to the cards in the possession of each player.

A further type of development board game is disclosed in U.S. Pat. No. 4,076,249 to Sneathen, Jr. In this game, players make random moves depending upon the roll of dice along paths which indicate lot developments. If a player has sufficient cash at the proper position on the board they may purchase a lot and thereafter separately develop the lot utilizing cards indicating engineering, paving, sewer and water hookups and the like. In addition, sales may be made of real estate. Other cards indicate penalties or rewards granted to the player during the course of the game.

Another real estate game apparatus is disclosed in U.S. Pat. No. 4,382,602 which is designed to simulate action taken by agents and purchasers relative to the sale of real estate. The game board includes a selection device and cards which grant rewards or setbacks for each player depending upon their position on the game board. The board includes an outer series of spaces which provides for the players attempting to locate prospective real estate listings and buyers and a separate inner track or series of spaces for listing property to be sold. There is no provision for actually constructing a house or selecting a house to be constructed and thereafter furnishing the house with articles of manufacture which may be designated on cards actually advertising the products or services to be rendered in building and furnishing a home.

In United Kingdom patent 611,043 issued Oct. 25, 1948 a game board is disclosed for selecting and constructing homes. The game includes a game board having three series of concentric spaces or squares over which playing pieces must be moved as required by the roll of a dice or some other chance indicating mechanism. During movement around the outer squares the players are subject to various rewards or penalty moves depending upon the designation of the square. Further, players acquire money for constructing their selected home by a movement around the outer series of squares. Once sufficient money is obtained the players move to the intermediate series of spaces wherein sections of the home must be obtained to complete construction. The game further includes actual small housing sections which may be assembled in either a two or three dimensional configuration to simulate the home being constructed. Once the home is constructed the player then moves into the innermost series of spaces in which final certification of the home are provided for. There are no provisions, however, in the game for dealing with situations wherein specific portions of a house and its furnishings must be provided for to educate the player to be prepared to encounter these expenses as well as to handle mortgage and construction costs. There is also no provision for allowing actual consumer goods and services to be advertised in the course of the game so that play becomes more realistic and thereby a better teaching tool for understanding home construction and furnishing.

Some additional references include U.S. Pat. No. 4,927,156; French patent 2,462,178 of March 1981; U.S. design Pat. No. 302,181; U.S. design Pat. No. 150,295; U.S. Pat. No. 4,714,255 and U.S. design Pat. No. 179,964.

SUMMARY OF THE INVENTION

A combination construction board game and advertising medium which includes a game board having a first series of spaces over which a player moves in order to obtain initial financing for home construction and furnishing and as well as to select from a plurality of home building cards a home to be constructed which home has given value with respect to the game being played. In the preferred embodiment, the first series of spaces also include spaces indicating both rewards or penalties to be applied to the player landing on the space with rewards including the right to obtain necessary assistance in house construction such as to select from a series of cards indicating builders, architects, type of housing construction such as siding, or arranging for self help construction, depending upon the desire of the individual. Each card designating a service or product is given a price for purchase and also a separate game rating amount which is utilized when totalling the score at the completion of play. Further, players are given the opportunity to make determinations with respect to the type of construction by selecting different qualifications of builders, architects and the like, with the some cards indicating special qualifications which will offset penalties which will be encountered in subsequent movement of game pieces along other sections of the game board so that a player may conservatively provide for a good builder or, in an attempt to save money, attempt to do the home development themselves with the potential that penalties will be incurred for inexperience with home building procedures.

The game board also includes a second series of spaces which require that home mortgages be paid and yet which also provide additional income depending upon the position of the game piece with respect to the second series of spaces. The second series of spaces also require specific furnishings to be provided for the house under construction. In this respect, house furnishing or amenity cards are provided which reflect actual pictures of the amenities to be provided, such as kitchen counters, refrigerators, stoves, swimming pools, living room sets and the like. In some instances, a variety of upgrades for amenities may be available if a player so chooses. Each card also carries a purchase price value and a separate value for determining game points at the end of the game. Upgraded items would generally have greater value.

In the preferred embodiment, at least a number of the amenity cards are provided with the actual identification of realistic business entities who make the product available. In this manner, the amenity cards may be utilized by manufacturers as an advertising medium which not only promotes their product but which also allows consumers to become familiar with the cost of products in a real market sense when considering the construction and the furnishing of a new home.

The game also includes tokens which are placed upon the second series of spaces in the event a player should become bankrupt during the course of play or be in a condition of being unable to purchase necessary or required furnishings or amenities. Once a token is placed on the board to indicate that there is a problem a player thereafter is moved to the first set of spaces to obtain additional financing through movement of a game piece relative to the board by a selection device such as a dice. In order to facilitate the reentrance of a player to the furnishing stage or second series of spaces on the game board a centralized detour is provided which separates the first series of spaces into essentially four quadrants so that a player may only proceed through one quarter of the first series of spaces in an attempt to gain additional financing at any one time.

The game is won by a player completely paying off their mortgage and furnishing their home in accordance with the instructions received by landing on the various spaces and thereafter the players totalling their cumulative home values as indicated on their home and amenity purchase cards.

It is the primary object of the present invention to provide a game board which is directed to selecting a house and thereafter obtaining proper building and financing for the house and for obtaining furnishing for the house with regard to specific rooms and other amenities associated therewith and wherein values are given to not only the housing values and lot values but the amenity values so that a player must make selections with regard to how money is spent during play in order to completely furnish a house and yet afford to pay the mortgages associated with a particular house plan selected.

It is yet another object of the present invention to provide a construction board game which not only educates individuals with regard to problems in home selection and financing as it relates not only with home completion but with home furnishing but which also allows advertising of specific home furnishings by manufacturers to be applied to game playing cards so that not only does the game become more realistic as specific home furnishings are purchased in the course of play but which also educates players to the relative values of home furnishings as they relate to different manufacturers.

It is also an object of the present invention to provide a construction board game apparatus which allows people to select house plans having differing values and therefore different financing and mortgaging values so that an individual must make decisions with regard to proper financing to obtain a home with the thought in mind that they must be prepared to also provide appropriate furnishings for completion of the house selected so that a player is educated not only in the home mortgaging phase but also as to the realistic costs associated with home furnishing.

BRIEF DESCRIPTION OF THE DRAWINGS

FIG. 6 is a top plan view of "your property value is down" card which contains instructions to a player during the course of play.

FIG. 6A is a bottom plan view of the card of FIG. 6.

FIG. 7 is a top plan view of "your property value is up" card utilized in the course of play.

FIG. 7A is a bottom plan view showing the instructions with respect to the card of FIG. 7.

FIG. 8 is a top plan view of a "construction problem" card utilized in the course of play.

FIG. 8A is a bottom plan view showing instructions for the card of FIG. 8.

FIG. 9 is a top plan view of an "architect selection" card utilized in accordance with the present invention.

FIG. 9A is a bottom plan view of the card of FIG. 9.

FIG. 10 is a top plan view of a "builder card" utilized in the course of play.

FIG. 10A is a bottom plan view of the card of FIG. 10.

FIG. 11 is a "siding" card utilized in the course of play.

FIG. 12 is a "lot" card utilized in accordance with the course of play.

FIG. 13 is an "interior room amenity" card utilized in the course of play.

FIG. 14 is an "appliance amenity" card utilized in the course of play.

FIGS. 15 and 15A are the top and bottom plan views of "changes cause delay" cards utilized in accordance with the present invention.

FIG. 16 is a top plan view of an example of money utilized in playing the board game of the present invention.

DESCRIPTION OF THE PREFERRED EMBODIMENT

Figure 1:
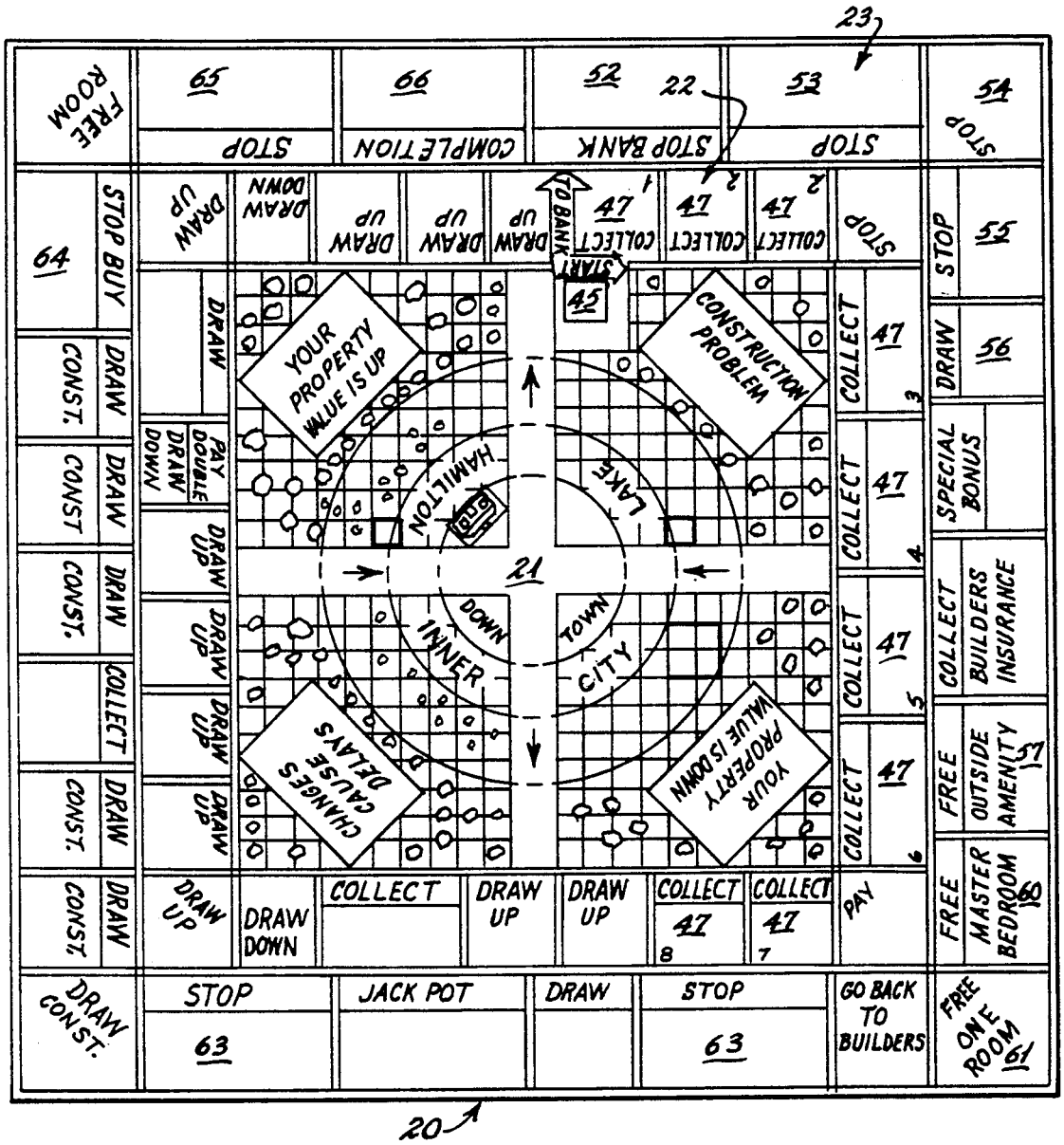
FIG. 1 is a top plan view of one type of layout for a game board which may be utilized in accordance with the teachings of the present invention.
Figure 2:
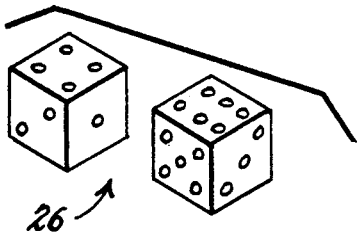
FIG. 2 is a perspective view of one type of chance device for indicating movement of game pieces.
Figure 3:
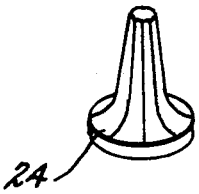
FIG. 3 is an example of a game piece which may be utilized with the present invention.
Figure 4:
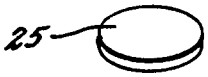
FIG. 4 is an example of one type of marker which may be utilized to indicate positioning of pieces during the course of play in accordance with the teachings of the present invention.

With continued reference to the drawing figures, FIG. 1 represents one configuration of a game board which may be utilized in accordance with the teachings of the present invention. It should be noted that different configurations of game boards may be utilized but still remain within the teachings of the present invention.

The game board 20 generally consists of a central crossover area 21 and two series of concentric squares or spaces 22 and 23, respectively. The game is designed to be played by two or more players with each player receiving a game piece 24 and a game piece token or chip 25. Generally the color of the game piece and the color of the token for each player are the same so that the token will identify a player's position on the game board when a game piece is removed from that position, as will be discussed in greater detail hereinafter. Movement of the game pieces 24 is determined by the roll of dice 26. For purposes of game play two dice are rolled and the player may choose the amount showing on either dice for purposes of selective movement of their respective game piece.

The movement of the game pieces 24 is not only done through the roll of dice but is regulated by instructions which may be provided on the various spaces to which a game piece is moved and by various cards which the player may be instructed to draw from during the course of play. In this respect, the game board is designed to be utilized with a plurality of cards indicating "your property value is up" with such cards being designated at 30. The "property value is up cards" include bonuses for players receiving additional money as designated on the reverse side of the cards 31. The "property value is up" cards also include instructions with regard to positive action which must be taken by a player if such action has not previously been taken.

With specific reference to FIG. 7A, the instructions on "your property value is up" card indicates that the player must either purchase a lot, a builder, siding, elect to build yourself or to select an architect. The concept is that the player must decide by selecting from a number of lot cards, siding cards, builder or build it yourself cards and architect cards exactly how the house is to be constructed. Only one of each category of cards need be purchased and each card indicates a specific game point value for the card and a cost value to acquire. By way of example and with respect to FIGS. 9 and 9A, one of a plurality of architect cards is disclosed. Each architect card 32 indicates a photo identity of the architect, a purchase price for hiring the architect and a scoring point value. Further, on the backside of each card are instructions 31 which indicate a variety of positive or negative features associated with the architect which features will be related to instructions received during the course of play to either countermand or overrule negative or penalty instructions received during the course of the game. The more qualifications that the architect will have the more protection a player will receive during the course of play, however, the greater the cost to acquire the architect. The player must therefore make determinations and balance between the capital that the player has to spend and the need for the architecture and the architect's services.

Each player will also have to make determinations with regard to acquiring a builder or decide to build self-help. With respect to FIGS. 10 and 10A, a plurality of "builder cards" 34 are shown which indicate the identity of the builder, the builder's fees and the total scoring points utilized to determine the final tally of points at the end of each game. On the back 35 of each of the builder cards are a series of positive and/or negative traits which will be utilized to offset, override or countermand penalty instructions received during the course of play. Again, the more value a player pays for the builder the more qualifications the builder has and therefore the more likely a player may overcome pitfalls associated with penalty instructions received during the course of play.

With regard to FIGS. 11 and 12, a plurality of cards 36 are provided for selecting various siding which may include, brick, vinyl, aluminum, wood or stucco with each having a respective purchase price and some point value and a plurality of cards 37 utilized to select lots, with each lot having different costs depending upon the lot value and with each lot being given a separate point values for scoring the game. Although not shown in the drawing figures, separate cards may be provided for building the house by self-help with such cards indicating potential pitfalls that the homeowner may encounter if landing on appropriate spaces due to the homeowner's unfamiliarity with construction and financing problems. However, if a purchaser builds the home themselves then, of course, they would not have to provide the costs for incurring builder or architect cards.

With continued reference to the game board 20 there is also provided a space for a plurality of cards indicating "your property value is down". These cards are represented in FIGS. 6 and 6A at 38 and 39. As shown on the backside of the card various penalties are shown indicating that a player must pay for various events which have occurred during the construction of a home and may indicate not only cash payments but movements of the game piece.

Also associated with the game board is a space on which a plurality of cards are placed indicating "construction problems". The "construction problems" cards are exemplified in FIGS. 8 and 8A and designated at 40. The backside of the construction problem cards 41 indicate situations which may occur during normal construction projects. Each card will indicate that the player must incur some penalty unless they have taken provisions by proper hiring of responsible architects, builders and the like and will therefore have to pay cash or go back to certain spaces. Therefore, the "construction problem" cards relate to the provisions that a player elects to take when deciding on building a house self-help or utilizing the services of various architects and builders. Further, such construction problem cards may be affected by the type of lot or siding that an individual has paid for with the higher the cost paid generally providing for a more penalty-free purchase.

The final space on the central portion of the game board 20 indicates "changes cause delay". In the game each player will be given a number of cards which may be placed at any selected point along the playing route to delay the movement of game pieces with respect to the series of spaces 22 an 23. If a "changes cause delay" card is placed on a given space the first player coming to that space must stop and lose one turn plus pay the player having placed the card a designated amount. A number of the "changes cause delay" cards indicate on the rear surface that they are also "safe" cards. If a player reaches a "changes cause delay" card they may bypass the card by playing a "changes cause delay" card having a "safe" label reflected on the surface thereof. In some events other provisions such as rolling doubles on the dice may be utilized to avoid the penalty associated with the "changes cause delay" cards. Once a "changes cause delay" card has been played it is placed in the appropriate space indicated on the game board. The "changes cause delay" cards are shown in FIGS. 15 and 15A with the front of the card being indicated by 42 and the rear by 43.

With continued reference to the game board 20, the inner concentric series of spaces 22 are designed to assist a player in collecting capital or funds to build a house selected and to thereafter to be in a position to pay for its financing and its furnishing. Each player begins at the start line 45 moving onto the inner series of spaces 22 in a clockwise manner a number of spaces indicated by the number on the dice being rolled. On those spaces that indicated "collect" a cash amount will be indicated which the player may collect from a bank from which various denominations of play money 46 is paid to the player. Each of these first series of spaces designated at 47 also indicate a possible house selection. The house selections are indicated by the numbers 1–8 shown in each space. A player may elect a house plan in accordance with the space on which they have landed and may exchange a house plan for one of a greater value if they should land on a space indicating a house plan of a higher value.

Figure 5:
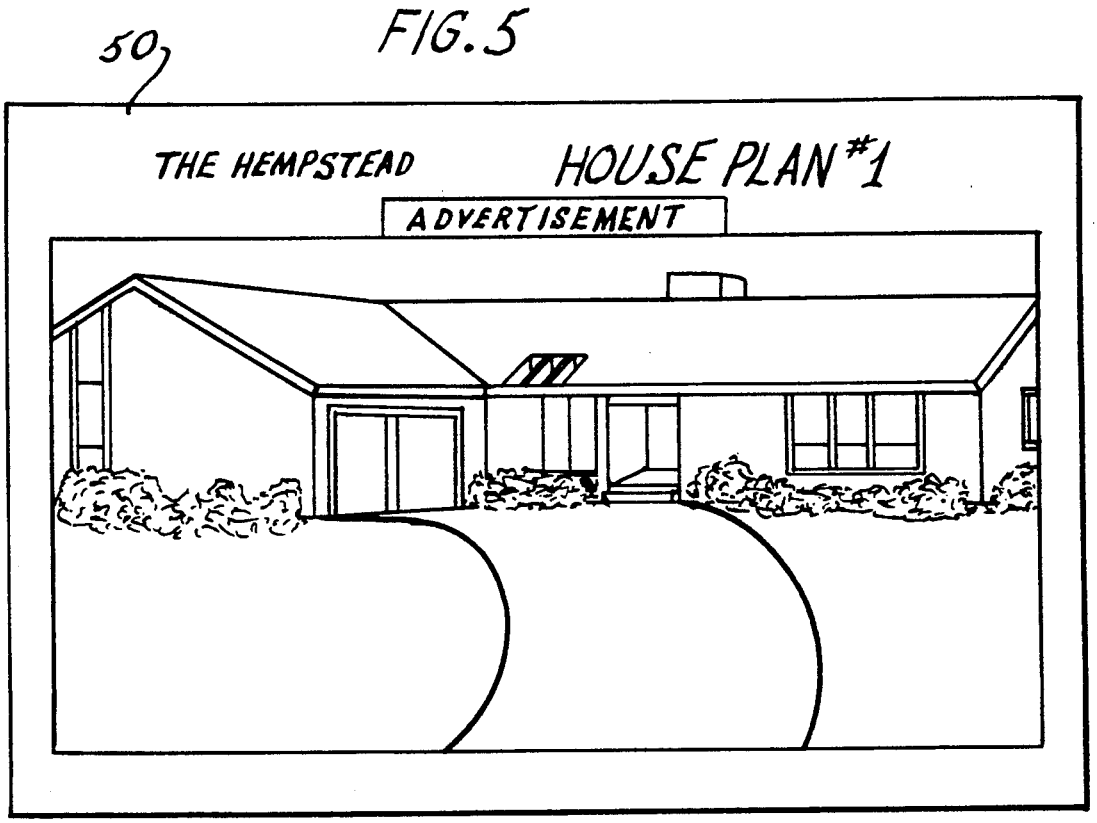
FIG. 5 is a top plan view of one of a series of "house plan" cards which may be selected by a player during the course of play.
Figure 5A:
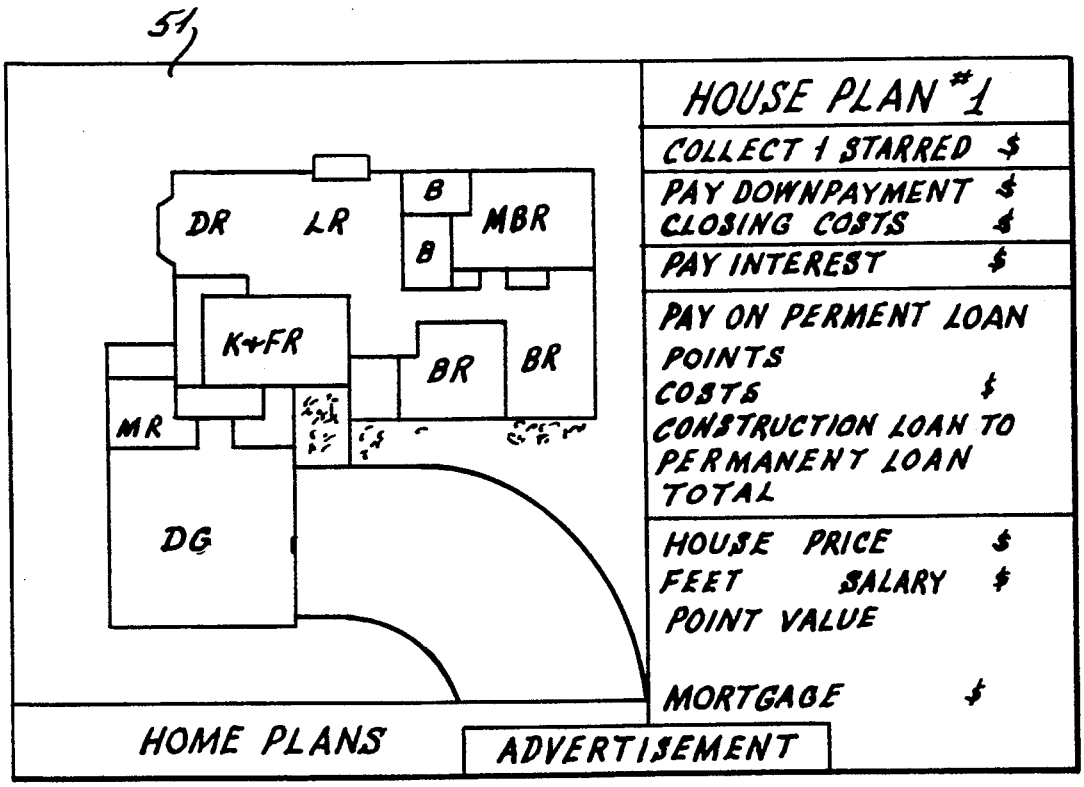
FIG. 5A is a bottom plan view of the "house plan" card of FIG. 5.

The house plans are shown on "house plan" cards 50 which in the example shown number 8 in number. The rear 51 of the "house plan" card shown at FIG. 5A shows a floor plan and gives various information with respect to mortgages, interests and payments to be paid to or paid out by the player during the course of play. For instance, the player will be allowed to collect certain monies at various spaces on the game board depending upon the collection amounts indicated on the rear of the card. Further, the card will indicate down payment and closing costs and interest payments which must be paid during the course of play. Further information with respect to the general salary which would be required to support house payments of the type are indicated together with other details deemed necessary. Further, each "house plan" card will be given a purchase price. The down payment and closing costs on the house are not paid until the player enters the bank space 52 on the outer series of concentric spaces 23. At this time the player will also be granted a collection amount as indicated on the back of the "house plan" card. Each card will also have a point value for purposes of totalling the score at the end of each game.

Returning to the description of the game board 20, once a player has selected a "housing plan" card from one of the spaces 47 the player continues of move along the inner concentric series of spaces and may land on spaces indicated by "draw up", "collect", "draw down" or "pay double spaces". The "draw up" and "draw down" spaces indicate that a player must draw one of the respective cards 30 or 38 and either make the purchase required for your "property value is up" and collect the bonus amounts or pay the penalty associated with "your property value is down".

Once a player has completed passing through the inner concentric series of spaces 22 to obtain their house plans and financing as well as making determinations with respect to architects, siding, builders or building self-help and lot selection, they are prepared to move to the outer series of spaces as indicated at the arrow which directs them to the "stop bank" square or space 52. At this point a player will be given an amount indicated on the back of their "house plan" and as a collection or salary amount and must thereafter make down payment and pay closing costs on their construction loan as reflected on the back 51 of the "house plan" cards 50. In the event a player does not have sufficient capital to make the appropriate payments they must place their token 25 on the square or space and thereafter, at the next roll of the dice, reenter the inner concentric series of squares 22 at any point or space which is contiguous to space 52. Thereafter, they will move clockwise through a quarter quadrant of the spaces 22 collecting funds as required as the player lands on the spaces designated 47. Once the player has moved through a quarter of the inner series of squares they must enter the pathways designated generally by 21 and return through such pathways to a connecting space on spaces 22 adjoining the space on which the token was placed. If sufficient funding has not yet been obtained then the player will continue to play along the quarter quadrant of spaces indicated.

Once a player has paid off their down payment and closing cost on their construction loan they may proceed to the next end series of spaces clockwise along such spaces 23, however, they are required to stop at each space indicating "stop" unless they have taken the action required for that space. For instance, space 53 requires that a builder be hired if one has not already been hired or that an election be made to build by self-help. The respective fees must also be paid as indicated on the "builder" cards 34. Space 54 requires that a player make an election with regard to selecting a lot and purchase the lot. Again, if the player is not able to purchase a lot then they must place their token on the space and thereafter return to the inner series of spaces 22 to receive additional funding. At space 55 a player is required to pick their siding if not already chosen and paid for. Again, should a player become financially incapable of making the play they must place their token on the space and return to the inner series of spaces.

The next space indicated on the board 56 requires that the player draw a "construction problem" card and act according to the instructions on the card. As previously noted, some of the penalties imposed by construction problems are overcome by the selection of quality builders, architects and the like. Therefore, the player is rewarded if prior planning has been utilized to avoid construction problems.

The remaining spaces in the concentric series of spaces 23 indicate further construction problems or bonus situations for which players receive cash payments or penalties for which action must be taken, cash payments made, loss of turn or retracing of steps required. In addition, it is at this point in the game which each player must now begin to furnish their house. In some spaces such as 57 players will be allowed to select from a plurality of amenity or furnishing cards 58 and 59 such as reflected in FIGS. 13 and 14. It is noted that the amenity cards 58 and 59 indicate room additions, furniture, appliances, plumbing, lighting fixtures, exteriors, improvements such as patios and swimming pools and the like. It is a purpose at this point in the game for a homeowner to carefully select furnishings and other appliances and amenities which will add value to their home but must be careful to ensure that they have sufficient remaining capital to complete the furnishing of their home during the remaining course of play. The more furnishing and/or amenities obtained, the greater the chance of winning the game as the point values reflected on the cards 58 and 59 are totalled at the end of the game.

One of the primary characteristics of the present invention is that the cards 58 and 59 may be utilized as an advertising medium for name brand manufacturers of home furnishings and amenities, such as appliance manufacturers, lighting manufacturers, furniture manufacturers or distributors, contractors for outdoor plumbing and fencing and the like. In this respect, each card includes a photograph or other likeness of a known brand item together with an indication of the manufacturer or advertiser together with a purchase price of the item and its point value with respect to the game. In each category there may be several different options available either by the same manufacturer indicating upgraded items which would have greater value and therefore more point value for the game because they would be longer lasting items. In this manner, a player not only has a chance to furnish their home with various amenities but learn how to determine where to place emphasis on such things as upgraded carpeting, lighting and plumbing fixtures or what type of interior or exterior amenities are necessary and affordable. By utilizing actual advertisements each player will also obtain a realistic sense of the actual costs associated with products for educational purchases. The advertising medium may be changed and cards made separately available so that the game can be updated to keep current with newly manufactured products.

With respect to the game board, various spaces such as shown at 60 and 61 will allow a player to select free from a number of amenity cards to choose such items as room furnishings. In addition, there will be additional stop spaces such as shown at 62, 63 and 64 wherein a player must acquire a specific amenity such as a kitchen, a bathroom, various appliances or other furniture, whichever is specified on the playing space. In addition, on these spaces a player may also receive additional payments which may be indicated on the back of their "housing plan" card which would give them extra income. Once the player reaches the last "stop" space 65 of the outer concentric series of spaces 23 it will become necessary for them to pay the second interest payment on their construction loan and pay the permanent points and closing costs on their house plan. Again, if sufficient funds are not available at any point during the play of the game the player must move to the inner quadrant of spaces 22 to acquire additional funds placing their game marker 25 on the space that they had advanced to at the point and time when they were financially unable to continue.

Once the permanent loan has been paid the first player to roll a specified number may enter the last space 66 which is the final completion of the house. Bonus points may be awarded to the first player to complete their house. At this time, each player must tally the total number of game points from each of the "housing plan" cards, the builder, architect, lot, siding and amenity cards for reaching a cumulative total of points for each player. The player having the highest number of points upon the first player reaching completion of their home is the winner of the game. Reduction in game points may be required for each space a player has not reached or if all required amenities have not been acquired.

In addition to the use of specifically designated manufacturers on the cards 58 and 59 which are the "amenity" cards, it is also possible to designate actual home builders, architects or realtors on each of the housing plans which a player selects. This would allow national home builders to advertise various structures to the playing public. Further, the architect and builders and siding cards may also indicate actual entities for purposes of advertising their services or products. Also, at various spaces on the game board other manufacturers and entities involved in home development and home furnishing may also be advertised for purposes of enhancing the reality of the game as well allowing the game to function as an advertising medium.

I claim:

1. A combination board game and advertising medium for displaying products and businesses in the housing industry and products for housing to players of the game comprising, a game board having at least a first and second series of separate spaces, a source of play money, a plurality of said first spaces indicating play money paid to a player, at least one of said first spaces indicating a house plan selection, a plurality of house plan card means, said house plan card means including indicia indicating a house point scoring value and purchase information, at least two game pieces selectively movable along said first and second spaces, chance means for determining the number of spaces a game piece is moved, a plurality of house amenity card means, said second series of spaces including a plurality of spaces including indicia for permitting the selection of a house amenity card means for a house plan card means selected, each of said house amenity card means including a display of an amenity product and indicia as to its purchase and point scoring value, at least one of said home amenity card means including a display of a business said amenity product display, a plurality of builder card means each representing a builder and each having a stated point value, said builder card means each having a plurality of information about the builder thereon, a plurality of first game control card means including thereon a number of separate game control instructions with respect to a variety of actions which may be taken by a player, said instructions of said first game control card means directly referencing at least one of said plurality of information on said builder card means to thereby determine which of the variety of actions are to be taken by a player, and whereby total point values accumulated by a player are used to determine the outcome of the game.

2. The combination board game and advertising medium of claim 1 including second game piece means for designating a game piece location along said second series of spaces when said game pieces are moved from said second series of spaces to said first series of spaces.

3. The combination board game and advertising medium of claim 1 in which each of said house amenity cards displays a photograph of an amenity product.

4. The combination board game and advertising medium of claim 1 including at least one space along said second series of spaces indicating construction problems which may be incurred, and said first game control card means including a plurality of construction problem card means which are selected by a player when one of said game pieces is positioned on said at least one space indicating construction problems.

5. The combination board game and advertising medium of claim 4 including a plurality of lot card means, each of said lot card means indicating a property and its respective point scoring value.

6. The combination board game and advertising medium of claim 1 including a plurality of spaces on at least one of said first and second series of spaces indicating property value is up and property value is down, a plurality of property value card means including additional game control instructions thereon indicating action which may be taken by a player, and said additional game control instructions on at least some of said property value card means directly referencing at least one of said plurality of information on at least one of said builder card means.

7. A combination board game and advertising medium for displaying products and businesses in the housing industry and products for housing to players of the game comprising, a game board having at least a first and second series of separate spaces, source of play money, a plurality of said first spaces indicating play money paid to a player, at least one of said first spaces indicating a house plan selection, a plurality of house plan card means, said house plan card means including indicia indicating a house point scoring value and purchase information, at least two game pieces selectively movable along said first and second spaces, chance means for determining the number of spaces a game piece is moved, a plurality of house amenity card means, said second series of spaces including a plurality of spaces including indicia for permitting the selection of a house amenity card means for a house plan card means selected, each of said house amenity card means including a display of an amenity product and indicia as to its purchase and point scoring value, at least one of said home amenity card means including a display of a business related to said amenity product display, a plurality of architect card means, said architect card means each representing an architect and each indicating a value to be paid for an architect and each architect card means having a plurality of information about the architect, each of said architect card means having a different stated point scoring value, and a plurality of first game control card means including thereon a number of separate game control instructions with respect to a variety of actions which may be taken by a player, the instructions on said second game control card means directly referencing at least one of said plurality of information on said architect card means to thereby determine which of the variety of actions are to be taken by a player.

8. The combination board game and advertising medium of claim 7 including a plurality of spaces on at least one of said first and second series of spaces indicating property value is up and property value is down, a plurality of property value card means, said property value card means including additional game control instructions thereon indicating action which may be taken by a player, and said additional game control instructions on at least some of said property value card means directly referencing at least one of said plurality of information on at least one of said architect card means.

9. A combination board game and advertising medium for displaying products and businesses in the housing industry and products for housing comprising, a game board having at least a first and second series of separate spaces, a source of play money, a plurality of said first spaces indicating play money paid to a player when positioned on said first spaces, at least one of said first spaces indicating a house plan selection, a plurality of house plan card means, said house plan card means indicating a house point scoring value and purchase information, at least two game pieces selectively movable along said first and second spaces, chance means for determining the number of spaces a game piece is moved, said second series of spaces including a plurality of spaces indicating the purchase of amenities for a house plan means selected, at least one of said second spaces indicating payments to be made in purchasing a selected house plan means, a plurality of house amenity card means, each of said house amenity card means displaying a picture of an amenity product and its purchase value, a plurality of said home amenity card means displaying the identity of a business related to the amenity product displayed, a plurality of builder card means each representing a builder and even having a differently stated point scoring value, said builder card means each carrying a plurality of information as to the qualification of the builder and which qualifications relate to the stated point scoring value of said builder card means, at least one space along said second series of spaces indicating construction problems which may be incurred, a plurality of construction problem card means including thereon a number of separate game play control instructions with respect to a variety of actions which may be taken by a player, and the instructions on said construction problem cards directly referencing at least one of said plurality of information on said builder card means to thereby determine which of the variety of actions are to be taken by a player.

10. The combination board game and advertising medium of claim 10 including second game piece means for designating a game piece location along said second series of spaces when said game pieces are moved from said second series of spaces to said first series of spaces.

11. The combination board game and advertising medium of claim 9 including a plurality of lot card means, each of said lot card means indicating a property and its respective point scoring value.

12. The combination board game and advertising medium of claim 11 including a plurality of architect card means, said architect card means indicating a value to be paid for each architect and indicia with respect to qualifications of the architect and a different point scoring value.

13. The combination board game and advertising medium of claim 12 including a plurality of spaces on said first series of spaces indicating property value is up and property value is down, a plurality of property value card means which are drawn by a player after a game piece is positioned on one of said property value is up or property value is down spaces, said property value card means including additional game control instructions directly referencing at least one of said plurality of information on at least one of said builder card means and said architect card means indicating action which must be taken by a player.

14. The combination board game and advertising medium of claim 13 including a plurality of delay card means, said delay card means being separately placed upon any of said first and second spaces by a player, said delay card means indicating action which must be taken by a player whose game piece is positioned on a space during the course of play.

15. A combination board game and advertising medium for displaying products and businesses in the housing industry and products for housing comprising, a game board having a series of separate spaces, a source of play money, a plurality of said spaces indicating play money paid to a player, at least one of said spaces indicating a house plan selection, a plurality of house plan card means, said house plan card means indicating a house point scoring value and purchase information, at least two game pieces selectively movable along said spaces, chance means for determining the number of spaces a game piece is moved, a plurality of said spaces indicating the purchase of amenities for a house plan card means selected, a plurality of house amenity card means, each of said house amenity card means displaying a picture of an amenity product and its purchase and point scoring value, at least one of said home amenity card means displaying the identity of a business related to the amenity product displayed, at least one space along said series of spaces indicating construction problems which may be incurred, and game control cards including a plurality of construction problem cards having a number of game play control instructions thereon indicating a variety of actions which may be taken relating to the movement of a game piece located on said at least one space, a plurality of builder card means each representing a builder and each having a differently stated point value, and each builder card means each having a plurality of information about the builder, and at least some of said construction problem cards including game control instructions directly referencing at least one of said plurality of information on said builder card means, and whereby total point values accumulated by a player are used to determine the outcome of the game.

16. The combination board game and advertising medium of claim 15 including a plurality of architect card means, said architect card means indicating a value to be paid for an architect, each of said architect card means having a different stated point scoring value, and a plurality of additional cards having indicia thereon referencing said architect card means for controlling game play.

17. The combination board game and advertising medium of claim 16 in which a plurality of said spaces indicated property value is up and property value is down, a plurality of property value card means, said property value card means including additional game control instructions indicating action which must be taken by a player and which on at least some of said property value card means directly reference at least one of said architect and said builder card means.

* * * * *